US006485292B1

(12) United States Patent
Rhodes et al.

(10) Patent No.: US 6,485,292 B1
(45) Date of Patent: Nov. 26, 2002

(54) FLARE STACK FOR NATURAL GAS DEHYDRATORS

(75) Inventors: James E. Rhodes, Farmington, NM (US); Stafford E. Polk, Aztec, NM (US); Randy L. McDonald, Bloomfield, NM (US)

(73) Assignee: Process Equipment & Service Company, Inc., Farmington, NM (US)

( * ) Notice: Subject to any disclaimer, the term of this patent is extended or adjusted under 35 U.S.C. 154(b) by 49 days.

(21) Appl. No.: 09/696,814

(22) Filed: Oct. 25, 2000

Related U.S. Application Data

(60) Provisional application No. 60/166,628, filed on Nov. 19, 1999.

(51) Int. Cl.[7] ..... F23D 5/02

(52) U.S. Cl. ..... 431/202; 431/333; 95/166

(58) Field of Search ..... 431/202, 5, 119, 431/117, 118, 236, 333, 330, 222, 223, 331; 95/166

(56) References Cited

U.S. PATENT DOCUMENTS

| | | | | | |
|---|---|---|---|---|---|
| 2,393,231 | A | * | 1/1946 | Breese | 126/36 |
| 2,470,682 | A | * | 5/1949 | Breese | 431/123 |
| 2,725,337 | A | | 11/1955 | Laurence et al. | 196/11 |
| 3,190,342 | A | * | 6/1965 | Smith | 431/119 |
| 3,395,512 | A | | 8/1968 | Finney, Jr. et al. | 55/80 |
| 3,904,351 | A | | 9/1975 | Smith et al. | 431/284 |
| 3,932,111 | A | | 1/1976 | Liknes et al. | 431/202 |
| 4,003,722 | A | | 1/1977 | Holter | 55/68 |
| 4,021,189 | A | * | 5/1977 | Swann et al. | 239/424 |
| 4,118,173 | A | * | 10/1978 | Shakiba | 126/307 A |
| 4,162,145 | A | | 7/1979 | Alleman | 55/32 |
| 4,182,659 | A | | 1/1980 | Anwer et al. | 203/18 |
| 4,227,897 | A | | 10/1980 | Reed | 55/269 |
| 4,237,620 | A | | 12/1980 | Black | 34/72 |
| 4,280,867 | A | | 7/1981 | Hodgson | 159/47 |
| 4,372,290 | A | * | 2/1983 | Visos et al. | 122/18.3 |
| 4,494,967 | A | | 1/1985 | Barth | 55/74 |
| 4,516,932 | A | * | 5/1985 | Chaudot | 431/114 |
| 4,597,733 | A | | 7/1986 | Dean et al. | 431/285 |
| 4,676,806 | A | | 6/1987 | Dean et al. | 55/20 |
| 4,702,898 | A | | 10/1987 | Grover | 423/220 |
| 4,714,032 | A | | 12/1987 | Dickinson | 110/347 |
| 4,717,408 | A | | 1/1988 | Hopewell | 62/20 |
| 4,983,364 | A | | 1/1991 | Buck et al. | 422/189 |
| 5,163,981 | A | | 11/1992 | Choi | 55/32 |
| 5,221,523 | A | | 6/1993 | Miles et al. | 422/182 |
| 5,261,225 | A | | 11/1993 | Dickinson | 60/39.55 |
| 5,335,646 | A | * | 8/1994 | Katchka | 122/18.31 |
| 5,346,537 | A | | 9/1994 | Lowell | 95/161 |
| 5,484,279 | A | * | 1/1996 | Vonasek | 110/238 |
| 5,498,153 | A | * | 3/1996 | Jones | 431/117 |
| 5,514,305 | A | | 5/1996 | Ebeling | 261/114.2 |
| 5,520,723 | A | | 5/1996 | Jones, Jr. | 95/161 |
| 5,536,303 | A | | 7/1996 | Ebeling | 95/166 |
| 5,664,426 | A | | 9/1997 | Lu | 62/93 |
| 5,665,144 | A | | 9/1997 | Hill et al. | 95/179 |
| 5,766,313 | A | | 6/1998 | Heath | 95/161 |
| 5,882,486 | A | | 3/1999 | Moore, Jr. | 203/87 |
| 5,919,036 | A | * | 7/1999 | O'Brien et al. | 431/2 |

* cited by examiner

*Primary Examiner*—Henry Bennett
*Assistant Examiner*—Kathryn Ferko
(74) *Attorney, Agent, or Firm*—Head, Johnson & Kachigian

(57) ABSTRACT

A system for environmentally acceptably disposing of BTEX and/or VOC containing off gases, including entrained vapors and liquids that originate from gas processing equipment including a flare stack communicating at an upper end with the atmosphere, a steam cup supported within the flare stack, a gas inlet extending into the flare stack and into the steam cup and serving to convey off gasses into the flare stack and collect any entrained liquid carried by the off gasses and a burner positioned within the flare stack below the steam cup and connected to receive and burn a combustion gas/air mixture, heat produced by the burner serving to vaporize any entrained liquid collected in the steam cup and to combust any BTEX and/or VOC components of the off gasses and vaporized liquid into inert oxidized states that pass out the flare stack upper end.

7 Claims, 3 Drawing Sheets

FLARE STACK FOR NATURAL GAS DEHYDRATORS

REFERENCE TO PENDING APPLICATIONS

This application is based upon U.S. Provisional Patent Application No. 60/166,628 filed Nov. 19, 1999 entitled, "FLARE STACK FOR NATURAL GAS DEHYDRATORS".

REFERENCE TO MICROFICHE APPENDIX

This application is not referenced in any microfiche appendix.

BACKGROUND OF THE INVENTION

Previously issued United States Patents that provide background information concerning the technology to which this invention is directed include the following:

| PATENT NO. | INVENTOR | TITLE |
|---|---|---|
| 2,725,337 | Laurence et al. | Method and Apparatus for Low Temperature Separation and Stabilization of Liquid Hydrocarbons from High Pressure Natural Gas |
| 3,395,512 | Finney et al. | Method and Means for Cooling and Cleaning Hot Converter Gases |
| 3,904,351 | Smith et al. | Combustor and Method of Eliminating Odors Using the Same |
| 3,932,111 | Liknes et al. | Apparatus for Incinerating Combustible Wastes |
| 4,003,722 | Holter | Process and Arrangement for the Removal of Impurities From Gases |
| 4,162,145 | Alleman | Regeneration of Liquid Absorbents |
| 4,182,659 | Anwar et al. | Method of Concentrating a Water-Containing Glycol |
| 4,227,897 | Reed | Apparatus for Recovery of Flared Condensible Vapors |
| 4,237,620 | Black | Contactor |
| 4,280,867 | Hodgson | Glycol Regeneration |
| 4,494,967 | Barth | Process for the Removal of Impurities from a Gas Stream Containing Solvent Vapors |
| 4,597,733 | Dean et al. | Gas Heating System for Dehydrators and Like |
| 4,676,806 | Dean et al. | Temperature Sensitive Control System for Liquid Motor and Pump in a Natural Gas Dehydration System |
| 4,702,898 | Grover | Process for the Removal of Acid Gases from Gas Mixtures |
| 4,714,032 | Dickinson | Pollution-Free Pressurized Combustion Utilizing a Controlled Concentration of Water Vapor |
| 4,717,408 | Hopewell | Process for Prevention of Water Build-Up in Cryogenic Distillation column |
| 4,983,364 | Buck et al. | Multi-Mode Combustor |
| 5,163,981 | Choi | Method and Apparatus for Controlling Discharge of Pollutants from Natural Gas Dehydrators |

-continued

| PATENT NO. | INVENTOR | TITLE |
|---|---|---|
| 5,221,523 | Miles et al. | Contaminant Control System for Natural Gas Dehydration |
| 5,261,225 | Dickinson | Pressurized Wet Combustion at Increased Temperature |
| 5,346,537 | Lowell | Method and System for Controlling Emissions |
| 5,514,305 | Ebeling | Bubble Tray |
| 5,520,723 | Jones, Jr. | Method and System for Reducing Air Pollution from Natural Gas Dehydrators |
| 5,536,303 | Ebeling | Method of Low Temperature Regeneration of Glycol Used for Dehydrating Natural Gas |
| 5,664,426 | Lu | Regenerative Gas Dehydrator |
| 5,665,144 | Hill et al. | Method and Apparatus Utilizing Hydrocarbon Pollutants from Glycol Dehydrators |
| 5,766,313 | Heath | Hydrocarbon Recovery System |
| 5,882,486 | Moore, Jr. | Glycol Refining |

Hodgson, U.S. Pat. No. 4,280,867, discloses a reboiler used to heat wet glycol and water vapor is discharged. The dehydrated glycol then flows through a stripping column where glycol comes into contact with dry flue gas generated by a catalytic burner.

Anwar et al., U.S. Pat. No. 4,182,659, provides a system where wet glycol is initially drawn off into an expansion chamber where part of the hydrocarbon gases separate out, are drawn off and may be re-used as heating gas. The glycol is then heated to remove the majority of the water which is vented to the atmosphere. Finally, then glycol is heated at sub-atmospheric pressure (vacuum) to further purify it.

Holter, U.S. Pat. No. 4,003,722, discloses a system where gas may be purified by cleansing fluid. The cleansing fluid may be admitted from a flow circuit into an evaporator causing the impurities to be evaporated by heating. The impurities liberated in the evaporator are conveyed to a burner or combustion chamber and combusted.

The other previously issued patents provide information as to the state of the art of glycol dehydration of natural gas.

Accordingly, it is a principal object and purpose of the present invention to provide a system for control and disposal on contaminants released by natural gas dehydration processes.

It is further an object and a purpose of the present invention to provide a system for control and disposal of contaminants released in the glycol regeneration process wherein the contaminants are incinerated to reduce them to non-pollutant states.

It is further an object and a purpose of the present invention to provide a system for control and disposal of contaminants released in the glycol regeneration process which will not add undo back pressure to the reboiler.

BRIEF SUMMARY OF THE INVENTION

The present invention relates to a system for use to incinerate contaminants released in the regeneration or reconcentration of glycol, or similar liquid desiccant, employed in the process of dehydration of natural gas.

Natural gas processing usually includes removal of contaminants in order to produce a transportable natural gas product. One of the major contaminants removed from natural gas is water, either in the gaseous state or in condensed form. Other contaminants present in smaller quantities are BTEX and VOCs and other pollutants.

Most large volume dehydration units are of the glycol type. Glycol is a preferred liquid desiccant because it has a relatively high boiling point, is thermally stable and does not oxidize in normal use. The glycol used is normally of one of three kinds: ethylene, diethylene, or triethylene, with triethylene being the most frequently used at the present time. Water, including other pollutants in natural gas, is absorbed by contact with the glycol.

A typical dehydration facility includes an inlet gas scrubber and a separator where liquid accumulations that are easily separated are removed. The natural gas is then directed to a gas contractor where the glycol comes into contact with the gas, a majority of any entrained water and the water vapor being absorbed by the glycol producing what is known as "wet glycol". The dehydrated natural gas leaves the contractor tower where it is directed to be transported for use as fuel or raw material for the chemical industry. The wet glycol is directed from the contractor tower to a reconcentrator or reboiler column.

In the reboiler column the wet saturated glycol is heated to a temperature of between 380° to 400° Fahrenheit to boil off the water. The reboiler is usually maintained at the lowest possible pressure so that the water solubility of glycol is not increased. The vaporized water, along with the contaminants not removed with the skimming and filtration process, have, in the past, been vented to the atmosphere. Venting the contaminants to the atmosphere is becoming an increasing environmental problem. These odorous vapors emitted from the reboiler create uncomfortable living conditions and health concerns for local residents and workers.

New environmental laws have mandated a great reduction in the amount of pollutants that can be emitted from natural gas dehydrators. These pollutants consist primarily of BTEX and VOCs, and are absorbed from the gas stream by the glycol. Also, some natural gas becomes dissolved in the glycol, and since the function of a dehydrator is to remove water vapor from the gas stream, the glycol will also contain water. The glycol regeneration process utilizes a reboiler to heat the glycol and drive off the water, but the process also liberates the pollutants that are dissolved in the glycol. Current technology to control emissions consists of two methods: 1) The stream from the still column's outlet is condensed. The waste gas is flared and the liquid is trucked to disposal. Or, 2) The stream from the still column's outlet is condensed and the waste gas is compressed and injected into a gas sales line, the liquid, once again, being trucked to disposal. Obviously, the problem with both systems is dealing with the disposal of the BTEX and/or VOCs laden water. It is to this problem that the present invention is directed.

DETAILED DESCRIPTION OF THE PREFERRED EMBODIMENTS

Figure 1:
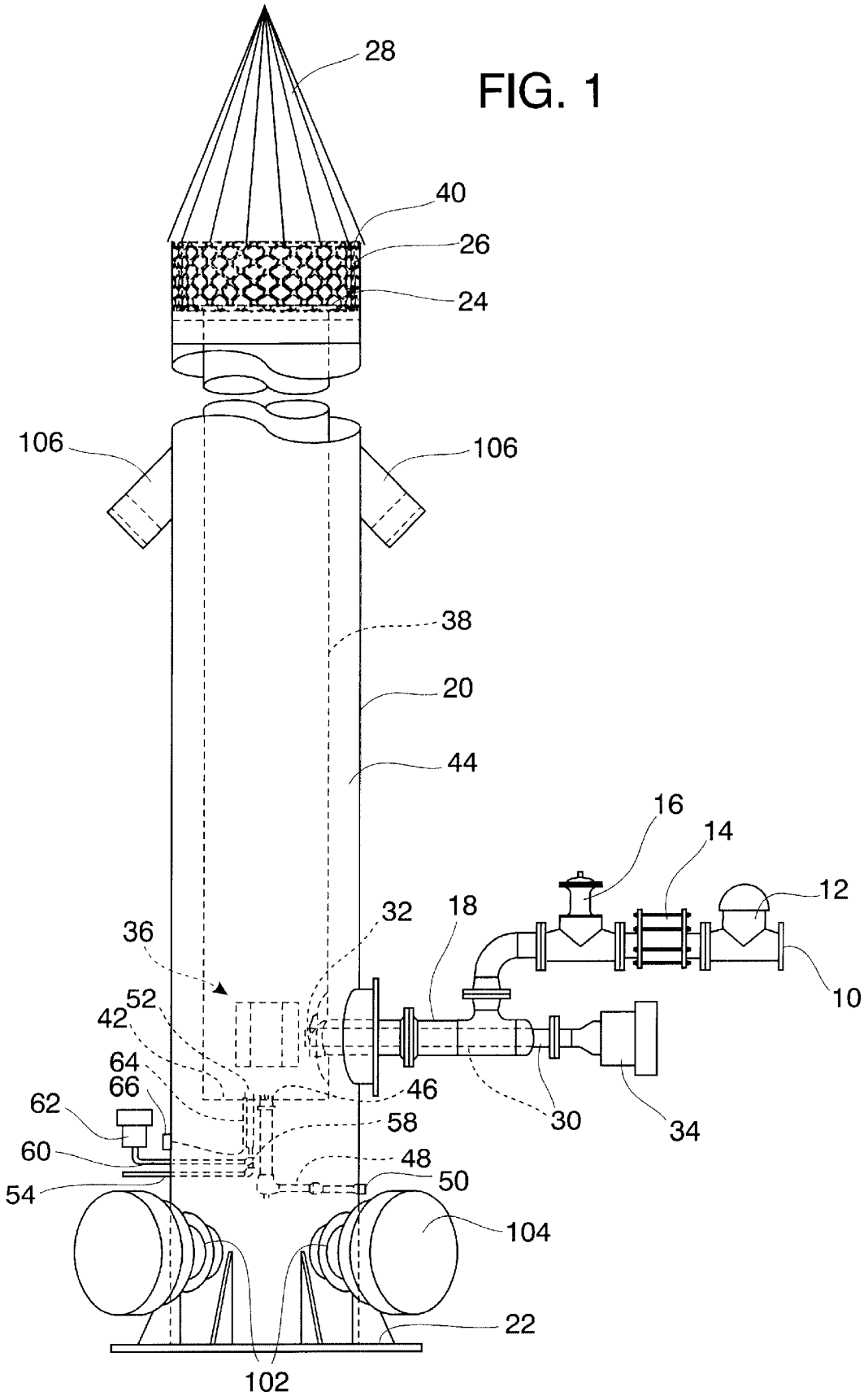
FIG. 1 is an elevational view, shown partially cut away, of a flare stack that employs the principles of this invention, the flare stack being used with natural gas dehydration systems.

Referring first to FIG. 1, the system of this invention for use with a natural gas dehydrator is shown. When natural gas is extracted from a subterranean formation it flows to the earth's surface by formation pressure. At the well site, the gas is collected. Natural gas contains essentially hydrocarbons but it inevitably includes, entrained within it, water that is usually in the form of vapor, a portion of which readily condenses into liquid when cooler temperatures are encountered along with decreased vapor pressure at the earth's surface. In addition to water, natural gas frequently includes other pollutants such as BTEX and VOCs.

Entrained water is a problem to the transportation, storage and use of natural gas. Accordingly, in the petroleum industry it is customary to extract as much as possible of entrained water before the natural gas is passed to a pipeline for transportation to an area where it is stored or used. Entrained water causes several problems in pipeline and process equipment including corrosion. Further, water tends to collect in low places in a pipeline and, if subfreezing temperatures are encountered, becomes ice or a solid to a point that the flow through a line can be severely restricted or blocked.

The most common means employed in the petroleum industry to extract water from natural gas is by the use of liquid dehydrators. In this process the natural gas is conducted into a vessel in which it is intimately mixed with a liquid desiccant. The most commonly used liquid desiccant is a glycol, either ethylene, diethylene, triethyline or mixtures thereof. Glycol makes an ideal liquid desiccant for natural gas because it is relatively inexpensive, has a relatively high boiling point, does not easily oxidize and is recyclable. After natural gas has been intimately exposed to glycol and the water carried in the natural gas has been absorbed by the glycol, the dried gas is separated from the glycol and passed to a pipeline for storage or use. The glycol (referred to as "wet glycol"), to be reused for drying additional natural gas must be treated to extract the entrained water. This is accomplished by heating the wet glycol to a temperature above the boiling point of water, to boil off the water without boiling the glycol so that the glycol remains in liquid state and the water is converted to a vapor state. In the past, the vapor that was created when water was boiled off of wet glycol was simply vented to the atmosphere. If the vapor is one-hundred percent water, that is pure water, the venting of the water vapor to the atmosphere is not harmful to the environment. However, inevitably, the vapor passing from a glycol regenerator includes other contaminants and pollutants particularly BTEX and VOCs. Environmental laws enacted in recent years have mandated that the discharge of these pollutants to the atmosphere should to be eliminated or at least substantially reduced. It is the object of the processes illustrated in FIG. 1 to accomplish this result.

The vapor or gas discharge from a glycol regenerator is fed to an inlet 10, through a vacuum/vent relief valve 12, and an inline flame arrestor 14, an emergency shut down valve 16 (an optional element) and through an injector tube 18 into the interior of a combustion tower 20. The combustion tower 20 is preferably formed of metal, such as carbon steel and may have a diameter, as an example, of about thirty inches and an overall height of, by example, twenty-four feet.

Combustion tower 20 rests on a base 22 and has, at its upper end 24, a vent screen 26 and a top cover 28.

Centrally positioned within air injection tube 18 is a smaller diameter air injection tube 30 having on its inner end a diffuser 32 and on its outer end, exteriorally of air injection tube 18, a flame arrestor 34. Thus injection tube 18 provides means for introducing the off gas from a glycol dehydrator flowing into the system through inlet 10 and admixing therewith secondary air as drawn into the system through flame arrestor 34. The inner end of injection tube 18 connects with a steam cup generally indicated by the numeral 36 that will be described in detail subsequently.

Centrally positioned within combustion tower 20 is a reduced diameter tower liner 38 that preferably is a metal, such as steel, and more particularly, preferably stainless steel. Liner 38 receives, in the lower end portion thereof the steam cup 36 and the top end 40 of liner 38 is substantially coincident with the upper end 24 of combustion tower 20. The bottom 42 of liner 38 is spaced above the tower base 22. Liner 38 provides an annular area 44 between it and tower 20.

Positioned within the lower interior of combustion tower 20 is a burner 46 connected by piping 48 to a fuel gas inlet 50. Fuel gas supplied to inlet 50 is generally gas that has been dissolved in the glycol employed for the dehydration process, the gas leaving the glycol when a pressure cut is taken in the glycol/gas separator forming a part of the dehydrator (not shown). This gas is considered waste gas and in the past has been vented to the atmosphere or burned in the reboiler to heat spent glycol as a part of the glycol regeneration process. The waste gas from the dehydration system can be supplemented as necessary by gas from other sources including commercially available clean, dehydrated gas.

The flame that is generated by burner 46 is best ignited from pilot light burner 52. A gas source is connected to pilot light inlet 54 that connects to pilot light burner 52 by means of piping 56. The pilot light gas is fed through a venturi 58 which draws pilot light combustion air through a pipe 60 that communicates with the atmosphere through pilot light flame arrestor 62.

Normally, pilot light burner 52 maintains a small pilot light flame continuously. Pilot light burner 52 may be manually lit through a closable opening formed in combustion tower 20 or, as illustrated, a pilot light ignitor 64 operated by a control 66 external of combustion tower 20 is provided. Ignitor 66 is typically designed to supply an electric spark for the purpose of lighting pilot light burner 52.

Figure 3:
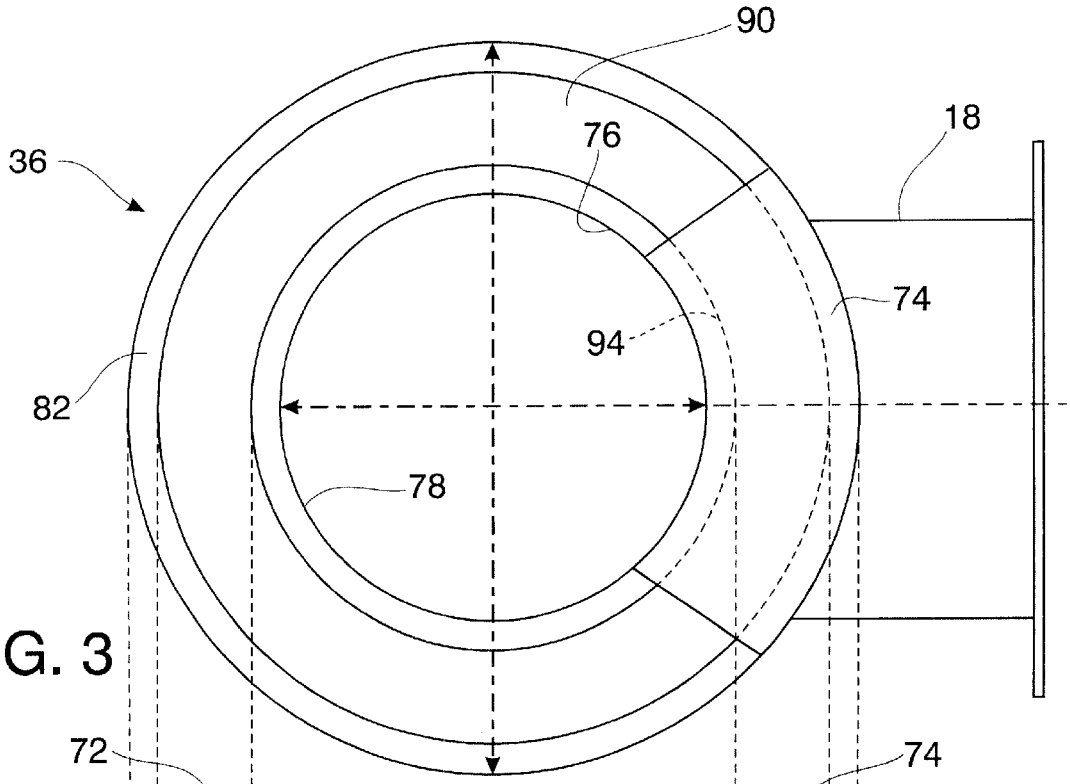
FIG. 3 is a top plan view of the flame cup of FIG. 2.
Figure 2:
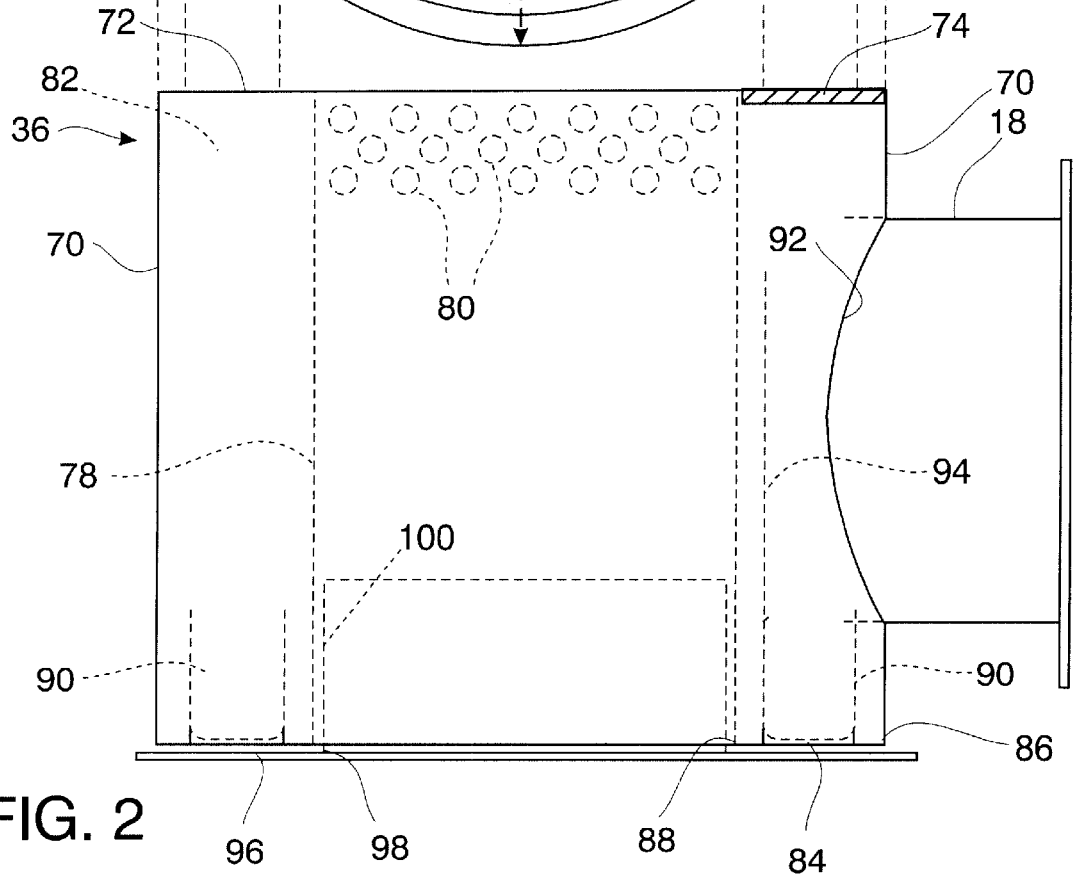
FIG. 2 is an enlarged elevational view of the flame cup as used in the flare stack of FIG. 1.

Positioned within the lower interior of combustion tower 20, also within the lower interior of tower liner 38, is a device referred to as a steam cup generally indicated by the numeral 36. The steam cup is illustrated in greater detail in FIGS. 2–4 and reference is now made specifically to FIGS. 2 and 3. The steam cup includes a cylindrical housing 70, made of metal and preferably a metal that resists heat, such as stainless steel. The top end 72 of cylindrical housing 70 is partially closed by a top deflector shield 74, a plan view of which is seen in FIG. 3. Top deflector shield 74 is semi-toroidal to deflect gases entering steam cup 36 from injector tube 18.

Received coaxially within cylindrical housing 70 is a flame chamber cylinder 78 formed of metal, and preferably of stainless steel or the like that resists heat. Spaced apart openings 80 are formed in the flame cylinder upper portion. Flame cylinder 78 forms an annular area 82 between its external cylindrical surface and the internal surface of cylindrical housing 70. Openings 80 provide communication between annular area 82 and the interior of flame chamber cylinder 78 that is open at the top so that the interior of flame chamber cylinder 78 communicates directly with the interior of tower liner 38.

Attached to the bottom of both cylindrical housing 70 and flame chamber cylinder 78 is a bottom ring 84. The external circumferential edge 86 of bottom ring 84 is secured, such as by welding, to the bottom external circumferential edge of cylindrical housing 70 while the internal circumferential edge 88 of bottom ring 84 is attached, such as by welding to the lower circumferential edge of flame chamber cylinder 78.

Positioned within the lower portion of annular area 82 within the steam cup is a toroidal cup-shaped member forming a liquid retention cup 90. The cup is toroidal in shape having an inner circumferential diameter greater than the external diameter of flame chamber cylinder 78 and an outer circumferential diameter less than the internal diameter of cylindrical housing 70. The liquid retention cup sits within annular area 82, resting on bottom ring 84.

The steam cup cylindrical housing 70 has a large diameter opening 92 in the sidewall thereof that receives injection tube 18 which extends slightly within annular area 82 within the steam cup 36 so that the edge thereof extends over the interior of liquid retention cup 90. Any liquids, such as condensed water that pass into the interior of combustion tower 20 and thereby into the interior of steam cup 36, are deposited within liquid retainer cup 90. The liquids are held in position in close proximity to the flame produced by burner 46 (as seen in FIG. 1) so that heat from the burner evaporates any liquids that are deposited into the liquid retention cup 90.

In the preferred arrangement liquid retention cup 90 includes an integral upwardly extending flash shield portion 94, the flash shield being of an arcuate configuration and covering an arch sufficient to stand between the inner end of injection tube 18 and flame chamber cylinder 78. The function of the flash shield 84 is to divert fluids and gases passing into the flame cup from direct impingement on flame chamber cylinder 78 and to help distribute the gases around the entire annular area 82.

Positioned below bottom ring 84 of steam cup 36 is a toroidal heat shield 96. Heat shield 96 has a large diameter opening 98 therethrough just slightly smaller in diameter than the interior diameter of flame chamber cylinder 78. Affixed to heat shield 96 at the internal circumferential edge of opening 98 is a short length upstanding tubular heat shield 100 that is open at its top and bottom. The short length tubular heat shield 100 and the toroidal heat shield 96 are welded together to form as an integral member and are made of metal to protect steam cup 68 from the direct intense heat of burner 46. The material of which the flat toroidal heat shield 96 and the short length tubular heat shield 100 are formed is such as stainless steel and may be of metal that is of thickness greater than the metal employed for forming cylindrical housing 70 and flame chamber cylinder 78.

The actual geometrical arrangement of steam cup 36 can vary considerably without departing from its basic and important function. For example, top deflector shield 74 can be eliminated without significantly changing the structure or the utility of the steam cup.

The method of supporting the heat shield formed of components 96 and 100 can vary such as by the use of clips (not shown) that extend externally of cylindrical housing 70 to be secured to cylindrical housing top edge 72. Another way is to provide short length bolts (not shown) extending from steam cup bottom ring 84 that are loosely received in openings formed in the flat toroidal heat shield 96. Heads on such bolts below heat shield 96 support the heat shield so that it is free to contract and expand without affecting the steam cup itself but at the same time provide protection against the direct intense heat of burner 46.

Returning to FIG. 1, openings are formed in the lower portion of combustion tower 20, spaced above the base 22, each opening being provided with a conduit 102. Each conduit 102 communicates with a primary flame arrestor 104. This permits combustion air to flow freely into the lower interior of combustion tower 20, the air being drawn upward by convection as a result of heat from burner 46. Some of the air being drawn through conduits 102 and flame arrestors 104 passes upwardly in the annular area 44 externally of the tower liner 38 and a portion of the air drawn through the primary flame arrestors 104 passes upwardly interiorially of tower liner 38. Some of the air flowing through primary flame arrestors 104 and conduits 102 serves to support combustion of the fuel injected through fuel inlet 50 to burner 46.

It is important that the system be constructed and operated in such a way that the possibility of igniting ambient gas that might inadvertently surround the flare stack be prevented. Therefore the temperature of the external surface of all portions of combustion tower 20 must, at all times, be below the ignition temperature of a natural gas/air mixture. If necessary, supplemental air may be introduced into annular area 44 by annular area flame arrestors 106 that may be positioned as required among the external sidewall of combustion tower 20. The sole function of flame arrestors 106 is to provide a cooling effect since air passing through annular area flame arrestors is not employed in the combustion process produced by burner 46.

Figures 4, 5:
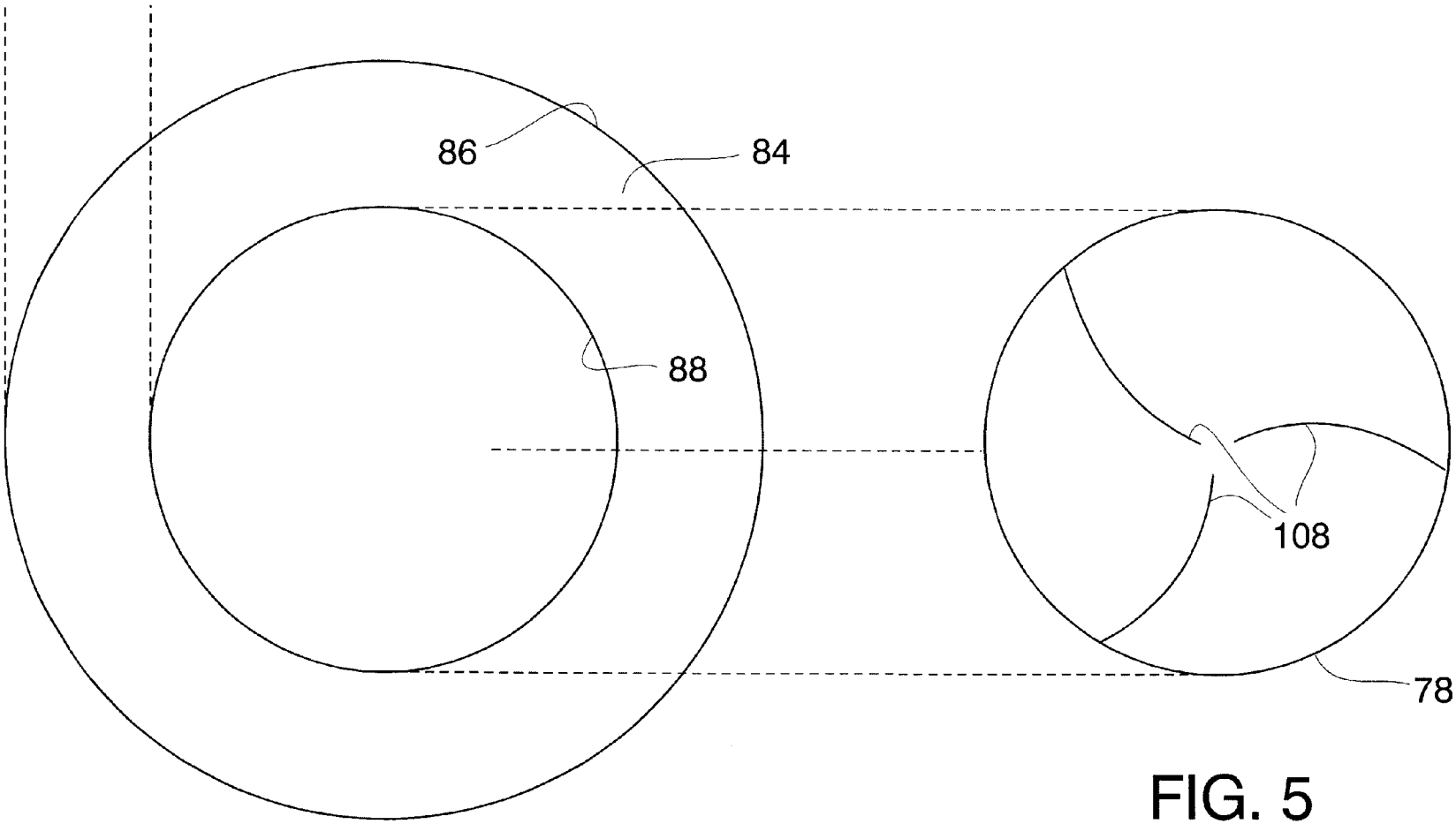
FIG. 4 is a bottom view of the heat shield as used as a part of the flame cup.
FIG. 5 is a cross-sectional view showing the use of turbulator blades within the flame cup as an alternate embodiment.

To increase the effectiveness of the contact of steam passing into the tower and into steam cup 36 with hot gasses produced by burner 46, turbulator blades 108 may be positioned within flame chamber cylinder 78 as seen in FIG. 5. The particular configuration of turbulator blades 108 is not important as long as turbulence is produced to more thoroughly heat the incoming steam.

When a reboiler (glycol regenerator) is employed to regenerate glycol or other liquid desiccant employed in dehydration of natural gas, the steam, along with any entrained liquids, is passed from the reboiler through the steam inlet 10 and flows through air injection tube 30 into the interior of combustion tower 20 and tower liner 38 and into the interior of steam cup 36. The flow of steam draws supplemental air through flame arrestor 34 so that a mixture of steam and air is passed into the opening 92 in the external sidewall of the steam cup 36. A flame is produced by fuel supplied at fuel inlet 50 to burner 46, the flame being located immediately below steam cup 36. Any liquid components of the vapor or gases passing into the interior of the steam cup are collected in liquid retention cup 90 contained within the steam cup. Liquid collected in retention cup 90 is subjected to intense heat and is vaporized and combusted to thereby convert any BTEX or VOCs into oxidized compositions that are safe to the environment. At the same time, any combustible components are burned. These combusted and oxidized components are passed upwardly within tower liner 38 and discharged through vent screen 26 to the atmosphere. The length of the tower is such as to provide positive movement of combustion air within the tower and past the steam cup and particularly past burner 46 to insure full combustion and oxidation of all components. The result is that all the biologically unacceptable components of steam discharged from a glycol generator, or other liquid desiccant regenerator used to extract water from natural gas, is reduced to an environmentally acceptable state before discharge into the atmosphere. The system avoids the problems and expense of separately disposing of this biological unacceptable waste.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure.

It is understood that the invention is not limited to the embodiments set forth herein for purposes of exemplification, but is to be limited only by the scope of the attached claim or claims, including the full range of equivalency to which each element thereof is entitled.

What is claimed is:

1. A flare stack system for a natural gas dehydrator for disposing of BTEX and/or VOC containing off gases, including vapors and liquids that originate from gas processing equipment comprising:

an upright flare stack having a closed lower end communicating at an upper end with the atmosphere;

a generally upright cylindrical steam cup supported within a lower interior portion of said flare stack;

a gas inlet having an inner end extending into said flare stack and into said steam cup and serving to convey off gasses into said flare stack and collect any liquid carried by said off gasses, an annular liquid retention cup, liquid tight on at least three sides, said retention cup positioned below an inner end of said gas inlet; and a burner positioned within said flare stack below said steam cup and connected to receive and burn a combustion gas/air mixture, heat produced by the burner serving to vaporize any liquid collected in said steam cup and to combust any BTEX and/or VOC components of said off gasses and vaporized liquid into inert oxidized states that pass out said flare stack upper end.

2. A system according to claim 1 wherein said gas inlet includes a secondary air inlet.

3. A system according to claim 1 wherein said flare stack is cylindrical and including:

an upright cylindrical liner received within said flare stack providing an annular area within said flare stack surrounding said cylindrical liner; and at least one air inlet extending through said flare stack and communicating with said annular area to thereby cool said flare stack.

4. A system according to claim 3 wherein said steam cup is within a lower portion of said cylindrical liner.

5. A system according to claim 1 wherein said steam cup has a short length, upright cylindrical housing and a concentric upright cylindrical flame chamber of reduced diameter providing an annular area there between and a tyroidal bottom ring closing a lower end of said annular area, said liquid retention cup resting on said bottom ring.

6. A system according to claim 5 including a toroidal heat shield positioned below said steam cup bottom ring.

7. A system according to claim 1 wherein said steam cup has a short length upright cylindrical housing and an upright cylindrical flame chamber of reduced diameter supported concentrically within said housing and including a plurality of spaced apart turbulator blades extending internally of said flame chamber.

* * * * *